US008931650B2

(12) United States Patent
McKendry et al.

(10) Patent No.: US 8,931,650 B2
(45) Date of Patent: Jan. 13, 2015

(54) VENTED BABY BOTTLE

(75) Inventors: Bruce McKendry, Benicia, CA (US); Sung Lee, Sacramento, CA (US)

(73) Assignee: L. Jason Clute, Alamo, CA (US)

( * ) Notice: Subject to any disclaimer, the term of this patent is extended or adjusted under 35 U.S.C. 154(b) by 1751 days.

(21) Appl. No.: 12/030,629

(22) Filed: Feb. 13, 2008

(65) Prior Publication Data

US 2009/0200257 A1 Aug. 13, 2009

(51) Int. Cl.
*A61J 11/02* (2006.01)
*A61J 9/04* (2006.01)
*A61J 1/20* (2006.01)

(52) U.S. Cl.
CPC .. *A61J 9/04* (2013.01); *A61J 11/02* (2013.01); *A61J 2001/2079* (2013.01); *Y10S 215/902* (2013.01)
USPC ..... 215/11.5; 215/11.1; 215/11.6; 215/12.1; 215/902; 220/592.15; 210/223; 210/282; 210/266; 210/443; 222/189.06

(58) Field of Classification Search
USPC ..... 215/11.5, 11.1, 11.6, 12.1, 902; 220/592.15; 210/223, 282, 266, 443
See application file for complete search history.

(56) References Cited

U.S. PATENT DOCUMENTS

| | | | | |
|---|---|---|---|---|
| 1,589,138 | A | 6/1926 | Fisk | |
| 2,096,961 | A | 10/1937 | Condon | |
| 2,575,283 | A | 11/1951 | Menrath | |
| 2,864,520 | A | 12/1958 | Pitavy | |
| 3,075,666 | A | 1/1963 | Hoffstein | |
| 3,311,248 | A | 3/1967 | Marchant | |
| 3,312,262 | A | 4/1967 | Hunter | |
| 3,871,543 | A | 3/1975 | Chadfield et al. | |
| 4,078,686 | A | 3/1978 | Karesh | |
| 4,215,785 | A | 8/1980 | Schwaiger | |
| 4,238,040 | A | 12/1980 | Fitzpatrick | |
| 4,429,798 | A | 2/1984 | Borows | |
| 4,865,207 | A | 9/1989 | Joyner et al. | 215/11.5 |
| 4,993,568 | A | 2/1991 | Morifuji et al. | 215/11.1 |
| 5,029,701 | A | 7/1991 | Roth et al. | |
| 5,099,998 | A | 3/1992 | Curzon et al. | |
| 5,339,971 | A | 8/1994 | Röhrig | 215/11.5 |
| 5,419,445 | A | 5/1995 | Kaesemeyer | |
| 5,499,729 | A | 3/1996 | Greenwood et al. | |

(Continued)

FOREIGN PATENT DOCUMENTS

| | | |
|---|---|---|
| DE | 1 753 146 | 7/1971 |
| DE | 44 16 685 | 11/1995 |

(Continued)

OTHER PUBLICATIONS

Nalgene GoCup™; webmaster@nalgenunc.com; 2004.

*Primary Examiner* — Fenn Mathew
*Assistant Examiner* — Cynthia Collado
(74) *Attorney, Agent, or Firm* — R. Michael West

(57) ABSTRACT

Baby bottles can have a single container, or two containers to create a space for thermal isolation, as selected by the user. The baby bottle can be vented to allow air to enter the bottle through a passageway as liquid is removed. A filter and one-way valve can be provided in the passageway. The passageway can be formed by radially aligning a vent opening in a top cap with a vent opening in a nipple flange, or by providing a channel in the top cap which is always in radial alignment with both the top cap vent opening and the flange vent opening.

14 Claims, 13 Drawing Sheets

(56) References Cited

U.S. PATENT DOCUMENTS

| | | | | |
|---|---|---|---|---|
| 5,570,796 | A | 11/1996 | Brown et al. | 215/11.5 |
| 5,573,507 | A | 11/1996 | Moser et al. | |
| 5,579,935 | A | 12/1996 | Atkin et al. | |
| 5,678,710 | A | 10/1997 | Sheu | 215/11.5 |
| 5,747,083 | A | 5/1998 | Raymond et al. | |
| 5,779,071 | A | 7/1998 | Brown et al. | 215/11.5 |
| 5,791,503 | A * | 8/1998 | Lyons | 215/11.5 |
| 5,881,893 | A | 3/1999 | Manganiello | 215/11.5 |
| 5,921,426 | A | 7/1999 | Randolph | |
| 6,003,698 | A | 12/1999 | Morano | |
| D420,448 | S | 2/2000 | Brown et al. | D24/197 |
| 6,032,810 | A | 3/2000 | Meyers et al. | 215/11.1 |
| D423,107 | S | 4/2000 | Brown et al. | D24/197 |
| 6,053,342 | A | 4/2000 | Chomik | |
| 6,068,147 | A | 5/2000 | Sheu | 215/11.5 |
| 6,253,935 | B1 | 7/2001 | Fletcher | |
| 6,446,822 | B1 | 9/2002 | Meyers et al. | |
| 6,499,615 | B1 | 12/2002 | Szieff et al. | 215/11.5 |
| 6,588,613 | B1 | 7/2003 | Pechenik et al. | 215/11.1 |
| 6,616,000 | B1 | 9/2003 | Renz | |
| 6,631,819 | B1 | 10/2003 | Diak Ghanem | |
| 6,666,345 | B2 | 12/2003 | Blanding | 215/11.1 |
| 6,722,513 | B1 | 4/2004 | Flood et al. | |
| 6,884,229 | B2 | 4/2005 | Renz | |
| 7,004,339 | B2 | 2/2006 | Renz | |
| 7,172,086 | B2 * | 2/2007 | McKendry et al. | 215/11.5 |
| 7,210,591 | B2 * | 5/2007 | Goldman et al. | 215/11.1 |
| 2003/0000907 | A1 | 1/2003 | Kevorkian et al. | 215/11.5 |
| 2003/0034321 | A1 | 2/2003 | Wu | 215/11.5 |
| 2003/0085193 | A1 | 5/2003 | Hsu | |
| 2003/0160019 | A1 | 8/2003 | Blanding | |
| 2004/0089626 | A1 | 5/2004 | Pyun | 215/11.5 |
| 2004/0118801 | A1 | 6/2004 | Brown et al. | |
| 2004/0164043 | A1 | 8/2004 | Hakim | 215/11.5 |
| 2004/0173556 | A1 | 9/2004 | Smolko et al. | 215/11.5 |
| 2004/0178163 | A1 | 9/2004 | Kerns et al. | |
| 2004/0188373 | A1 | 9/2004 | Lewis et al. | 215/11.5 |
| 2005/0035078 | A1 | 2/2005 | Lieberman et al. | 215/11.1 |
| 2005/0056610 | A1 | 3/2005 | Randolph et al. | 215/11.1 |
| 2005/0127020 | A1 | 6/2005 | Frisch | |
| 2005/0133546 | A1 | 6/2005 | Carvalho | 222/481.5 |
| 2007/0158251 | A1 * | 7/2007 | Chau | 210/223 |

FOREIGN PATENT DOCUMENTS

| | | |
|---|---|---|
| EP | 0 345 694 | 12/1989 |
| EP | 0 826 607 | 3/1998 |
| FR | 1102993 | 10/1955 |
| GB | 1152037 | 5/1969 |
| GB | 1248226 | 9/1971 |
| GB | 2 139 903 | 11/1984 |
| GB | 2 208 291 A | 3/1989 |

* cited by examiner

VENTED BABY BOTTLE

BACKGROUND OF THE INVENTION

Vented baby bottles such as those described in McKendry et al. U.S. Pat. No. 7,172,086 have an integral nipple and top cap. The present invention, made by the inventors of U.S. Pat. No. 7,172,086, is directed to various vented baby bottles having a nipple separate from the top cap. U.S. Pat. No. 7,172,086 is incorporated by reference in its entirety.

SUMMARY OF THE INVENTION

In keeping with one aspect of the invention, a baby bottle has a generally barrel shaped container and a top cap having a top portion and a threaded side portion. The top portion has a circular central opening and a top cap vent opening between the circular central opening and the side portion.

The bottle has a nipple having a small opening at one end and a large opening at the other end. The nipple can be secured in the top portion circular central opening. A flange surrounds the large opening and extends outwardly from the large opening. The flange has a vent opening and a boss for securing a vent to the nipple in communication with the vent opening.

The top cap vent opening, flange vent opening and the vent create a passageway from the outside atmosphere to the inside of the container. A filter and a one-way valve can be provided in the passageway, if desired. The one-way valve opens to allow atmospheric air to enter the container, and closes to prevent liquid in the container from escaping from the container through the passageway.

The vent is typically a tube that extends from the top of the container to near the container bottom. When the tube is secured, the air enters the assembled baby bottle through the passageway, into the container.

There are other aspects of the invention, such as a circular channel in the top cap that maintains the passageway even if the top cap vent opening and vent opening are not aligned. The container can be double-walled for improved thermal stability, and a nipple insert can be used to better seat the nipple in the top cap.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which.

DETAILED DESCRIPTION

Figure 1:
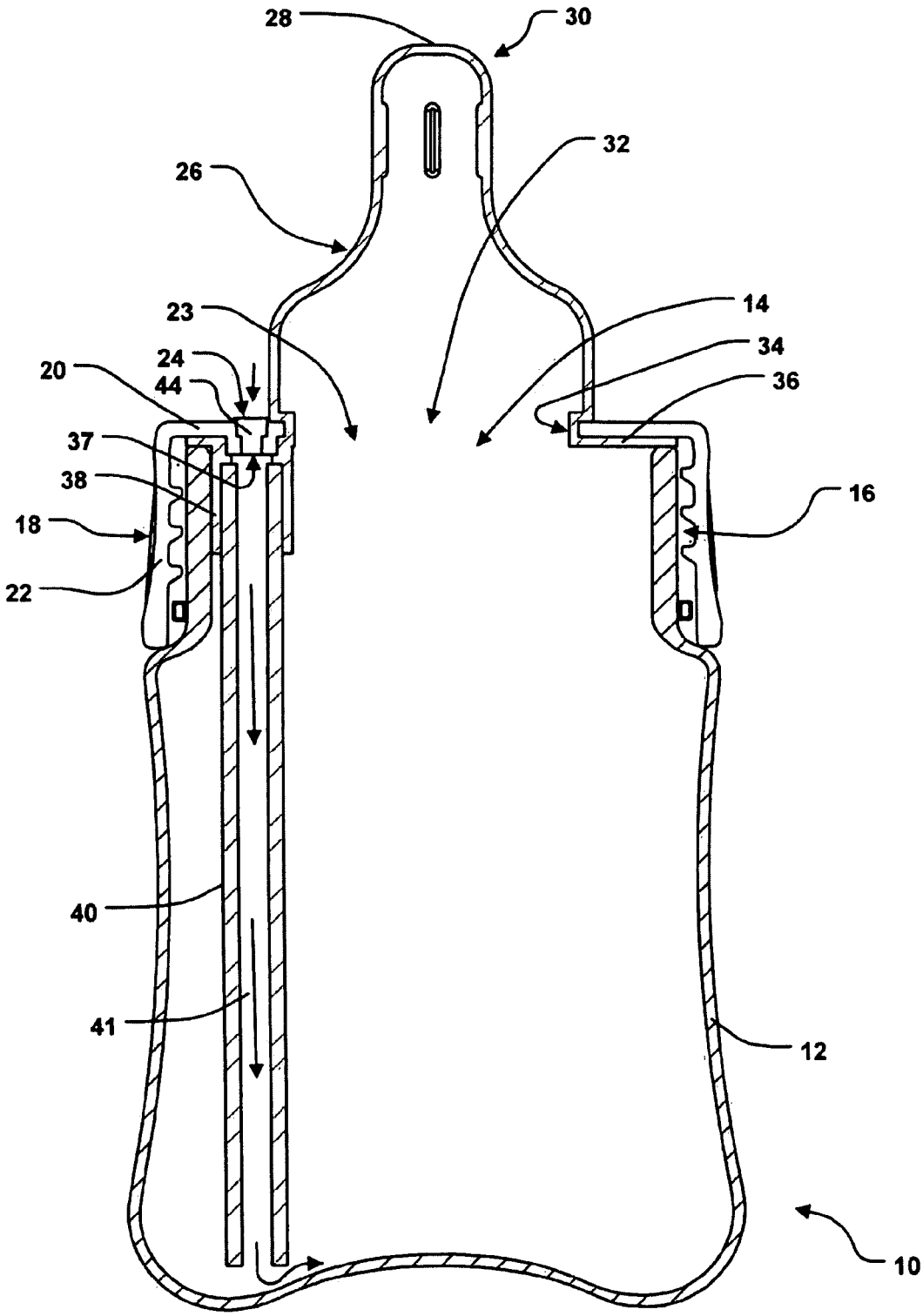
FIG. 1 is a cross-sectional diagram of one embodiment of the invention.

As seen in FIGS. 1-4, a baby bottle 10 includes a generally barrel shaped container 12 having a circular open top 14 and threads 16 surrounding the outside of the top 14. A top cap 18 in FIG. 1 (47 in FIG. 2) has a top portion 20 and a threaded side portion 22. The threaded side portion 22 can be secured to the container 12 by engaging the threads of the side portion with the threads of the open top, and can be removed easily from the container, as desired. The top portion 20 has a circular central opening 23 and a top cap vent opening 24 between the circular central opening 23 and the side portion 22.

A nipple 26, made of any suitable material such as silicone, TPE or latex, has a small opening 28 at an end 30, and a large opening 32 at its other end. The nipple can be secured in the top circular central opening 23 by providing an indented portion 34 near the large opening 32.

A flange 36, having an upper side and a lower side, includes a vent opening 37 (FIG. 4) passing therethrough. Flange 36 further includes a circular boss 38 on its underside for securing a vent tube 40 (FIG. 6) to the nipple 26, the boss 38 being in communication with the flange vent opening 37. The top cap vent opening 24, flange vent opening 37 and the tube 40 create a vent passageway 41 from an inside 42 of the container 12 to the outside atmosphere.

A filter 44 is provided in the passageway 41, in the top cap opening in FIG. 1, and a one-way valve 46 is also provided in the passageway. The one-way valve 46 can be a duckbill valve or the like that opens to allow atmospheric air to enter the container when liquid is removed through the opening 28. The valve closes to prevent liquid in the container from escaping from the container through the passageway.

The baby bottle 10 in FIG. 1 is assembled by inserting the end 30 of the nipple 26 through the circular central opening 23 of the top cap 18, and engaging the indentation 34 of the nipple 26 within opening 23 in the top cap]. The top cap 18 is then threaded to the container 12, with the nipple flange 36 then secured between the container 12 and the top portion 20. When so assembled, the top cap vent 24, flange vent opening 37 and vent tube 40 are in communication to form the passageway 41. In use, of course, the baby bottle is turned more or less upside down to draw milk or other liquid through the small opening 28. As the liquid is removed, a partial vacuum is formed within container 12, and air enters the baby bottle through the passageway 41 into the container 12 to equalize the pressure.

The filter 44 can be any suitable filter, such as a Pall filter. The filter 44 can be located in any suitable location in the passageway 41, including the top portion vent opening 24, as in FIG. 1. It could also be located in the nipple flange vent opening 37, or in the top, middle or bottom of the vent tube 40. Multiple filters could be used, if desired. It is preferable, though, that the filter be permeable to air and impermeable to liquid when wet and dry.

The indentation 34, which is formed in part by the flange 36, secures the nipple in the top portion 20. Among other things, the indentation 34 better secures the nipple in the top cap 18, even if the nipple is pushed down. The flange 36 provides additional security in this regard.

Figure 2:
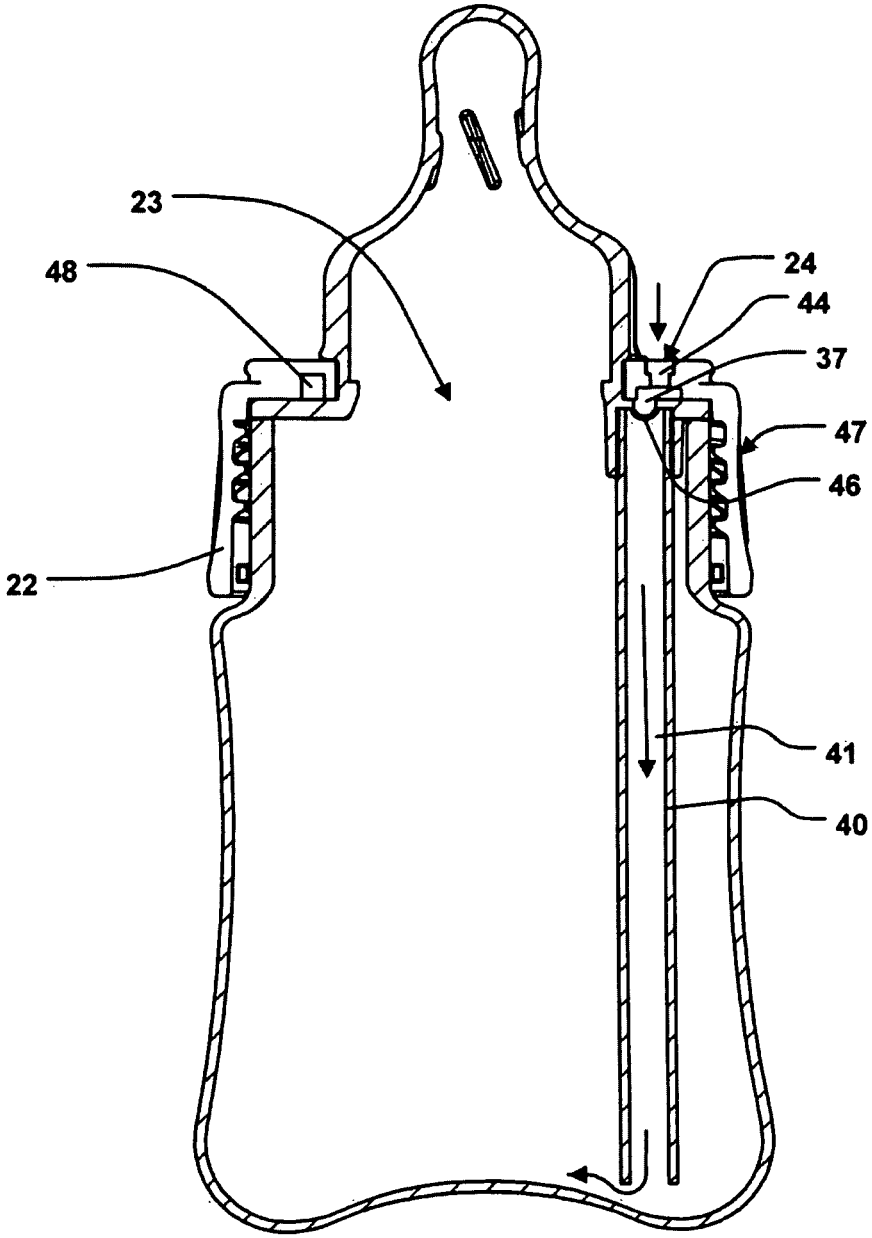
FIG. 2 is a cross-sectional diagram of a second embodiment of the present invention.
Figure 3:
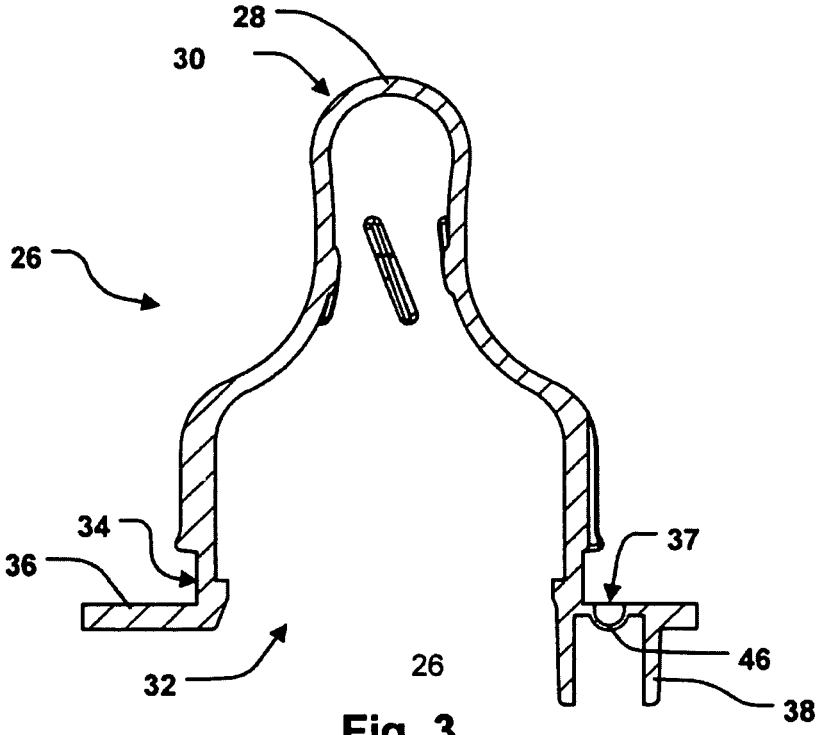
FIG. 3 is a cross-sectional diagram of a nipple used in the embodiments of FIGS. 1 and 2.
Figure 4:
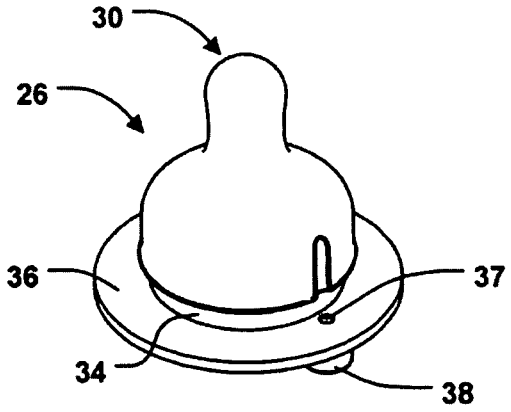
FIG. 4 is a perspective view of the nipple shown in FIG. 3.
Figure 15:
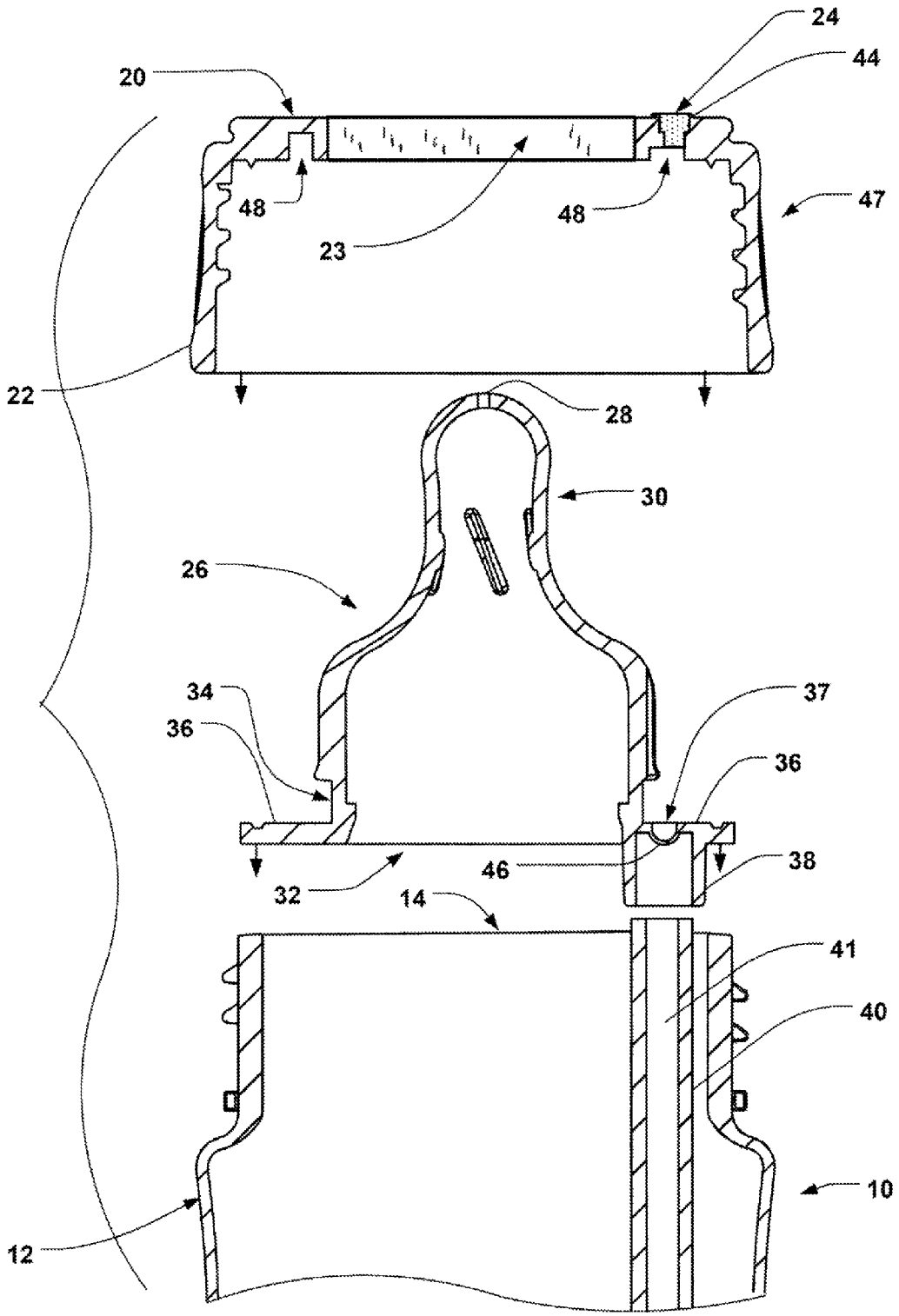

In FIG. 1, the top cap vent opening 24 and the flange vent opening 37 are aligned when the baby bottle is assembled, to form the vent passageway 41. In the embodiment of FIG. 2, also depicted in exploded cross-section in FIG. 15, a top cap 47 has a circular channel 48 between the circular central opening 23 and the side portion 22. When the baby bottle is assembled, the top cap vent opening 24 is in communication with the circular channel 48, and the vent opening 37 in the flange 36 is also in communication with the circular channel 48. The circular channel 48 forms part of the passageway 41, so that the inside of the container 12 is vented irrespective of whether the vent opening 24 in the top cap is aligned with the vent opening 37 in the nipple flange 36 when the baby bottle is assembled.

Figure 5A:
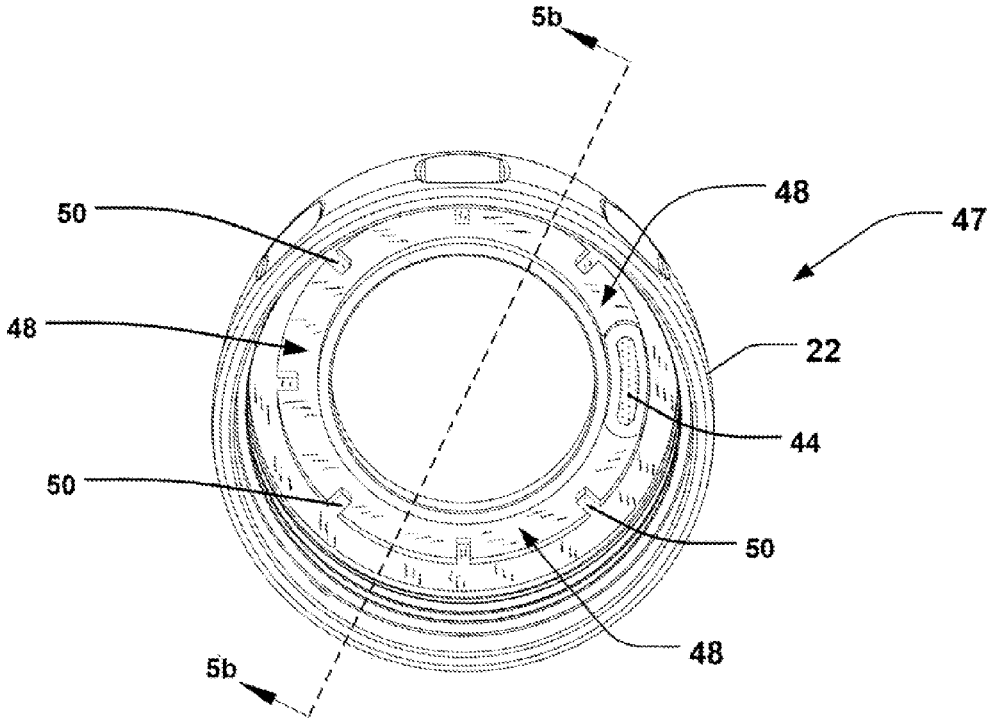
FIG. 5*a* is a perspective view of the inside of the top cap used in the embodiments of FIGS. 1 and 2.
Figure 5B:
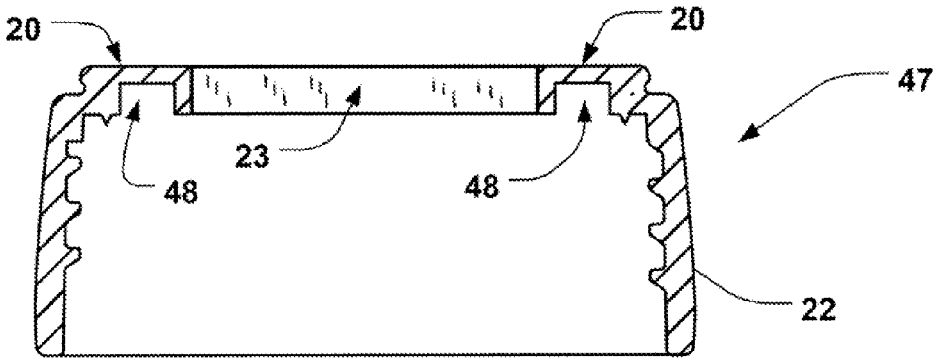
FIG. 5*b* is a cross-sectional view, taken on the line 5*b*-5*b*, in FIG. 5*a;*

As seen in FIG. 5, the channel 48 can have a plurality of spaced radial protrusions 50, which partially block the circular channel 48. If small amounts of liquid enter the circular channel 48 through the vent, the liquid is at least partially obstructed by the radial protrusions 50 and tends to accumulate between adjacent radial protrusions 50.

Figure 6:
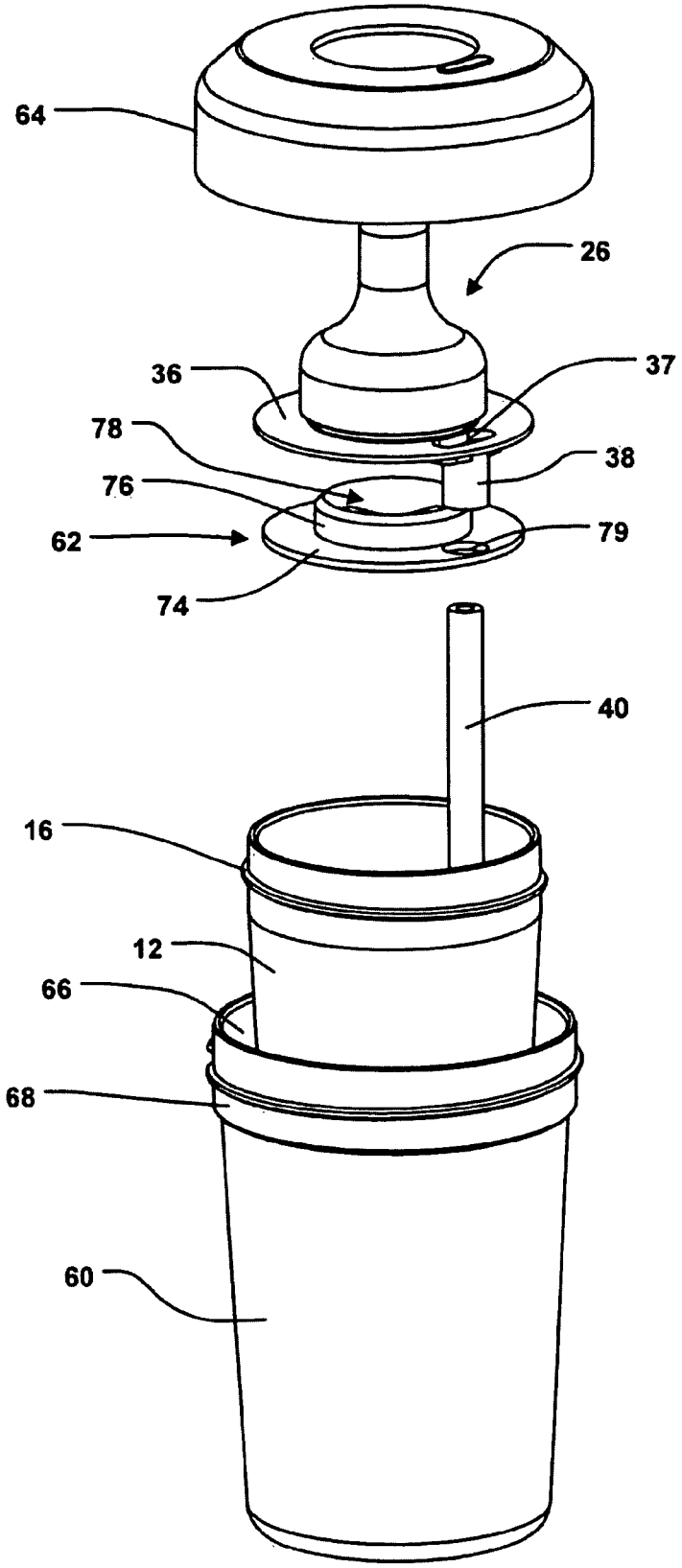
FIG. 6 is an expanded view of another embodiment of the present invention.
Figure 7:
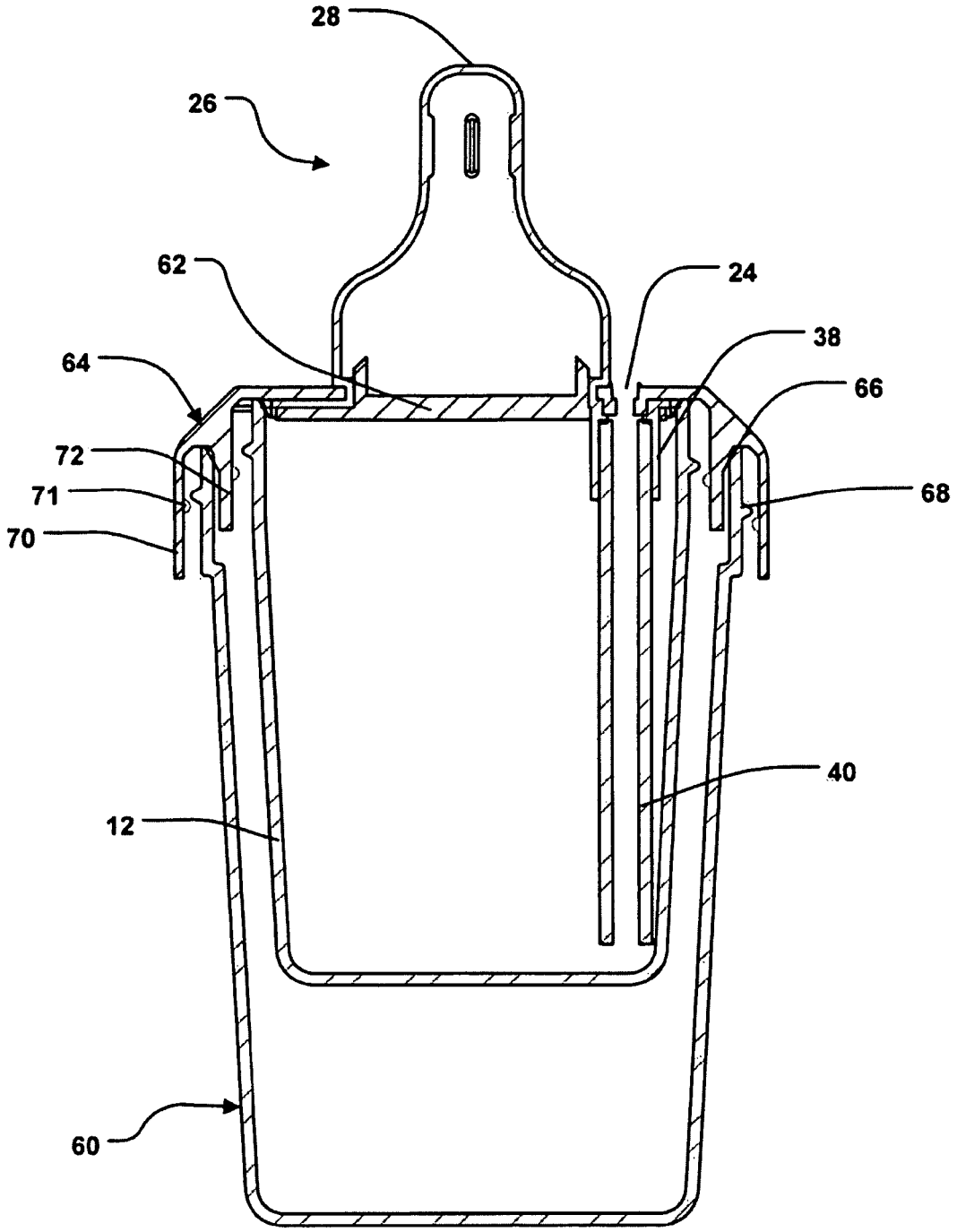
FIG. 7 is a cross-sectional diagram of the embodiment of FIG. 6, as assembled.

FIGS. 6 and 7 illustrate a double wall container configuration for use in the present invention. Reference numbers from the previous figures are used where appropriate. The bottles of FIGS. 6 and 7 include an outer bottle 60 and a nipple insert 62. A top cap 64 is similar to the top caps 18 and 47, but differs in some respects, as seen in FIG. 7.

The container 60 has an open end 66 and a threaded side portion 68. The top cap 64 includes a second side portion 70 having threads 71 that engage threads in the side portion 68. A downwardly extending flange 72 is provided to maintain a fixed space between the outer container 60 and the inner container 12.

The nipple insert 62 is located between the nipple flange 36 and the open end 14 of the container 12. The insert 62 has a flange 74, a circular cylindrical wall 76 around a central opening 78, and an opening 79. The wall 76 fits inside the nipple opening 32, and presses snugly against the inner sidewall of the nipple indentation 34. In this manner, the nipple is better locked in place in the cap with a frictional fit, preventing the nipple from being pulled out in an undesired manner. The nipple insert also improves the seal between the nipple 26 and the top cap 64, to prevent leak of liquids when the bottle is turned upside down.

The opening 79 is aligned with the circular boss 38. The nipple insert 62 can be a separate part or it can be over-molded or co-molded to the nipple 26, if preferred. The nipple insert 62 can be attached to the nipple 26 by welding, or with a mechanical latch mechanism.

Assembly of the bottle of FIGS. 6 and 7 is shown in FIG. 6, and is similar to the assembly of the embodiments of FIGS. 1-5. The outer bottle 60 is threaded into the top cap 64, and the insert 62 is placed in the assembly, before or after the nipple is installed into the top cap, and before the top cap is installed on the containers.

Another embodiment of the present invention is shown in FIG. 8, again using reference numbers from the previous figures where appropriate. A baby bottle 80 has an outer container 82 and an inner container 84 that form a space 83, a top cap 47 and a nipple 26. Though not shown, a filter and vent can be provided in this embodiment, as has been described with respect to other embodiments.

Figure 9:
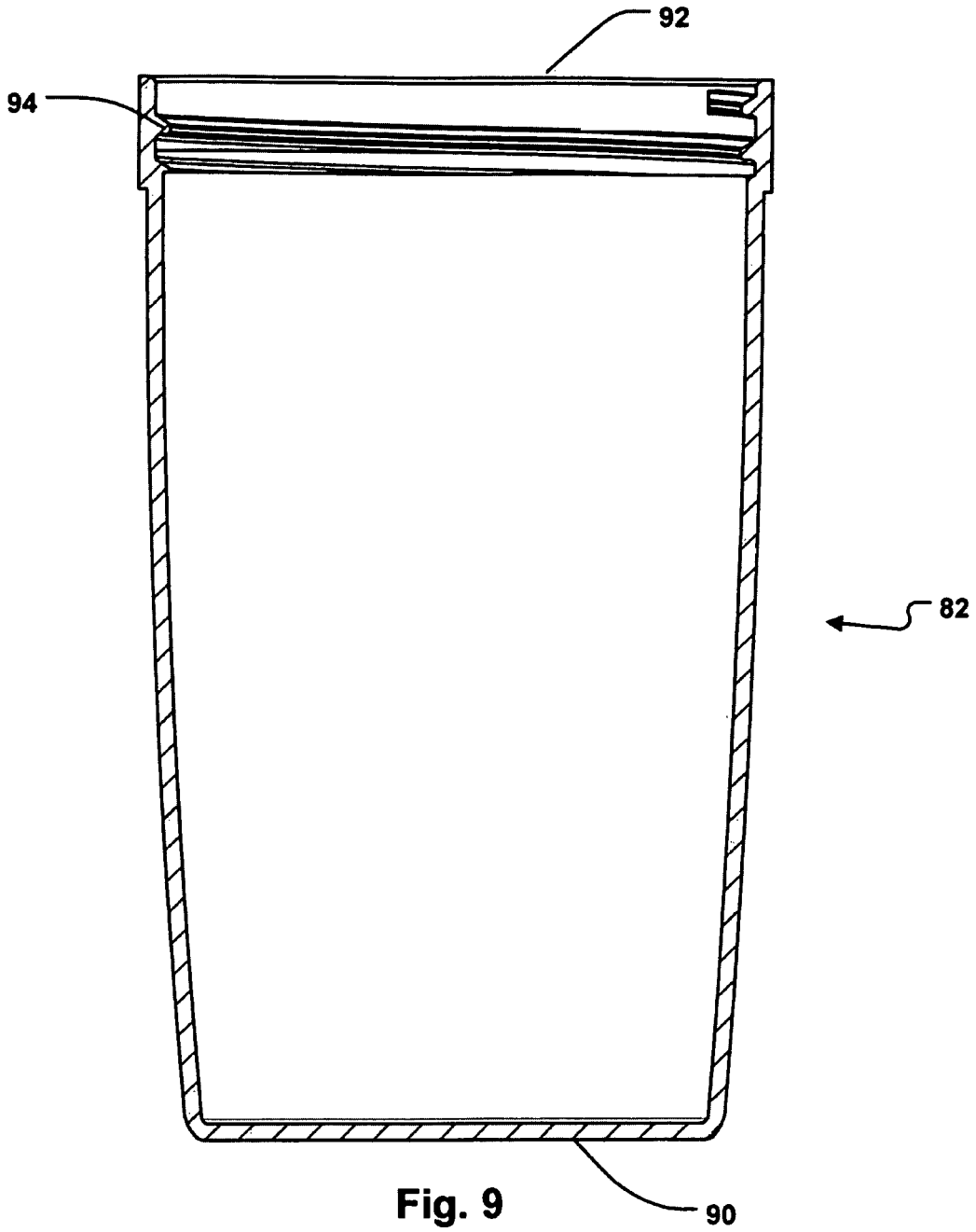
FIGS. 9-12 are cross-sectional views of another embodiment of the present invention.

The outer container 82 has a generally barrel shape with a closed bottom 90 and an open top 92 having interior threads 94 (FIG. 9). The inner bottle 84 also has a generally barrel shaped configuration, though it is smaller than the outer container 82, to create the space 83 for thermal isolation of the inner container from the atmosphere. The space 83 can contain air, warm liquid or cold liquid, as desired.

Figure 10:
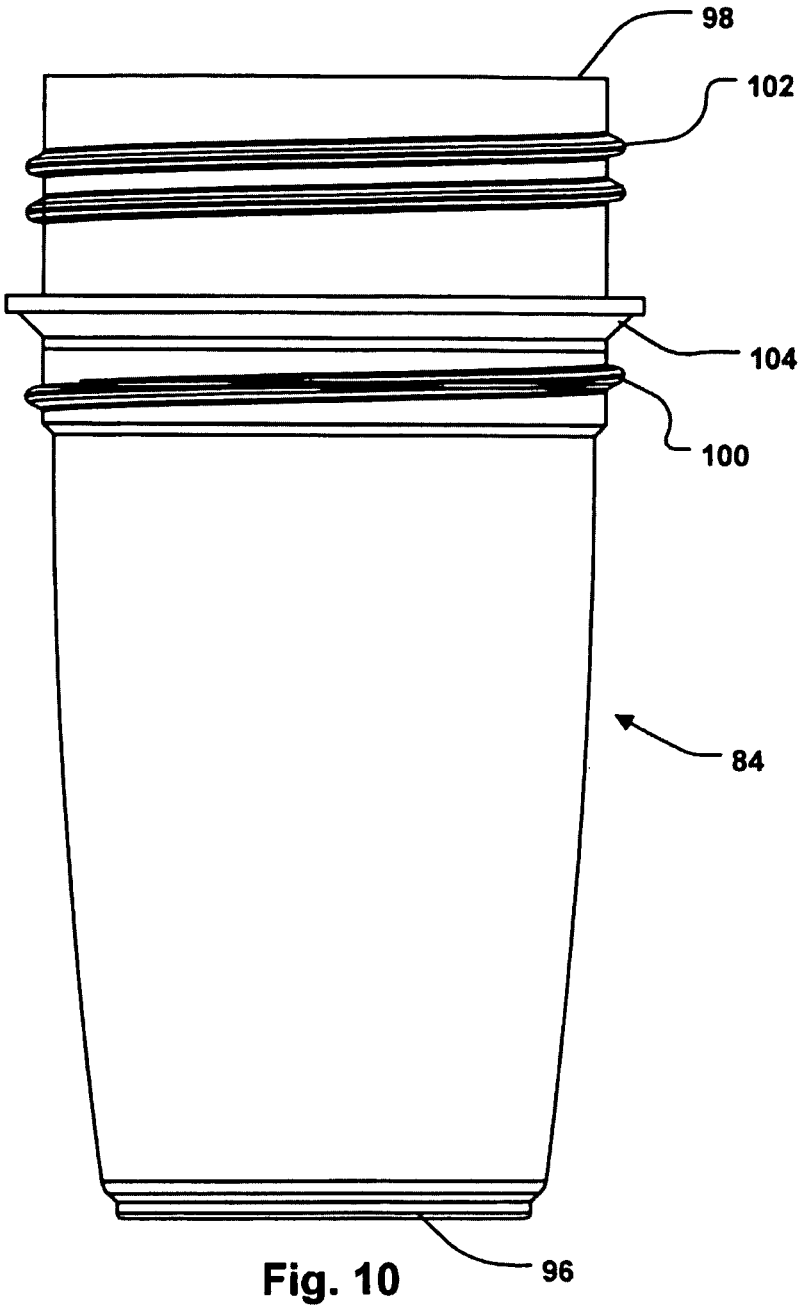

The inner container 84 has a bottom 96, an open top 98, outer threads 100 for engaging the threads 94 of the outer container 82, and outer threads 102 adjacent the open top 98, and above the outer threads 100, as seen in FIG. 10. The container 84 also has a lip 104 that seals the space between the containers 82, 84, when the outer container 82 is fully threaded onto the inner container 84, as in FIG. 8.

The nipple 26 is secured in the top cap 47 in the manner previously described, and the top cap 47 is threadedly secured to the inner container 84 by using the threads 102. In this manner, the top cap 47 and the outer container 84 are independently secured to the inner container 84 and the outer container 82.

Figure 11:
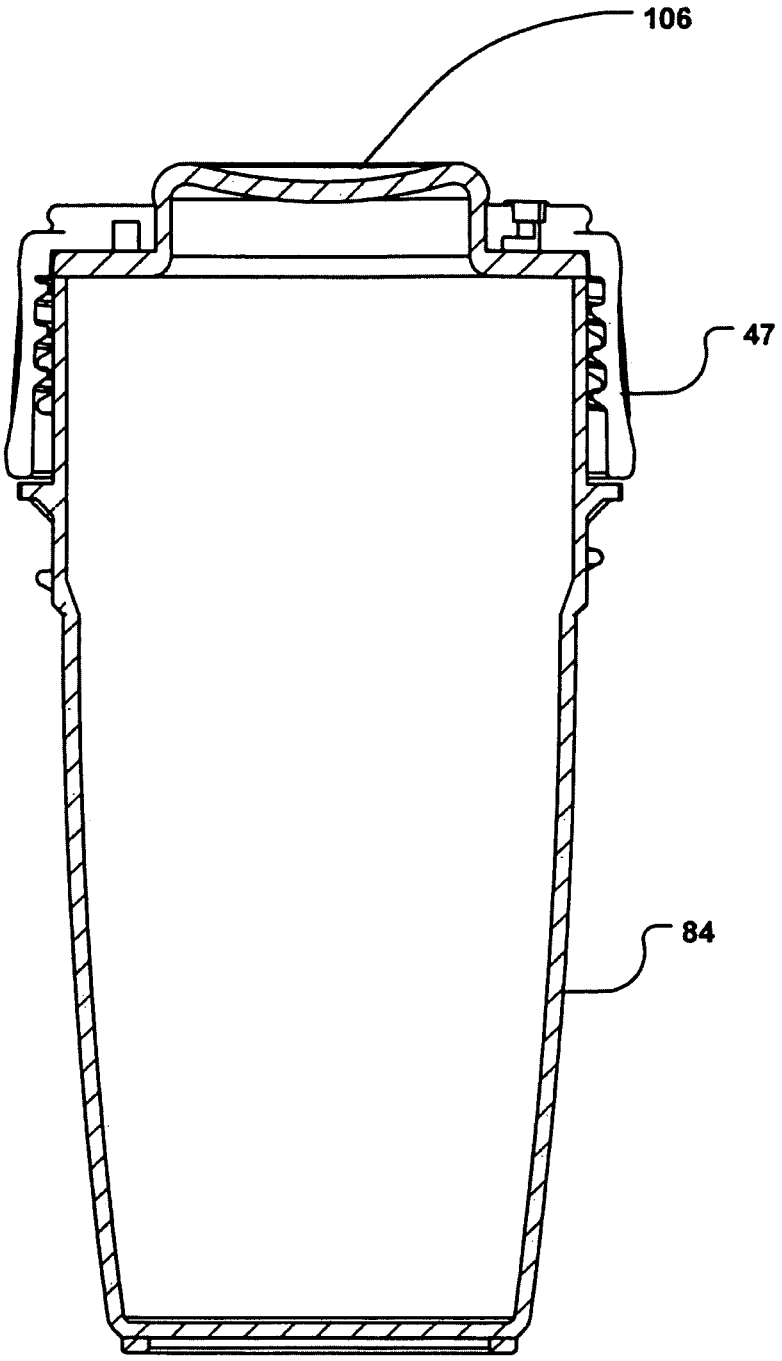

Milk or other liquid or solid materials can be stored in the inner container 84 for transportation using the sealing cap 106 shown in FIG. 11. The sealing cap 106 is preferably secured in the top cap 47 in the same manner as the nipple 26, but the sealing cap 106 does not have an opening to release the milk. However, the outer container 82 can still be placed on or taken off of the inner container 84, as desired, without removing the top cap 86.

Figure 12:
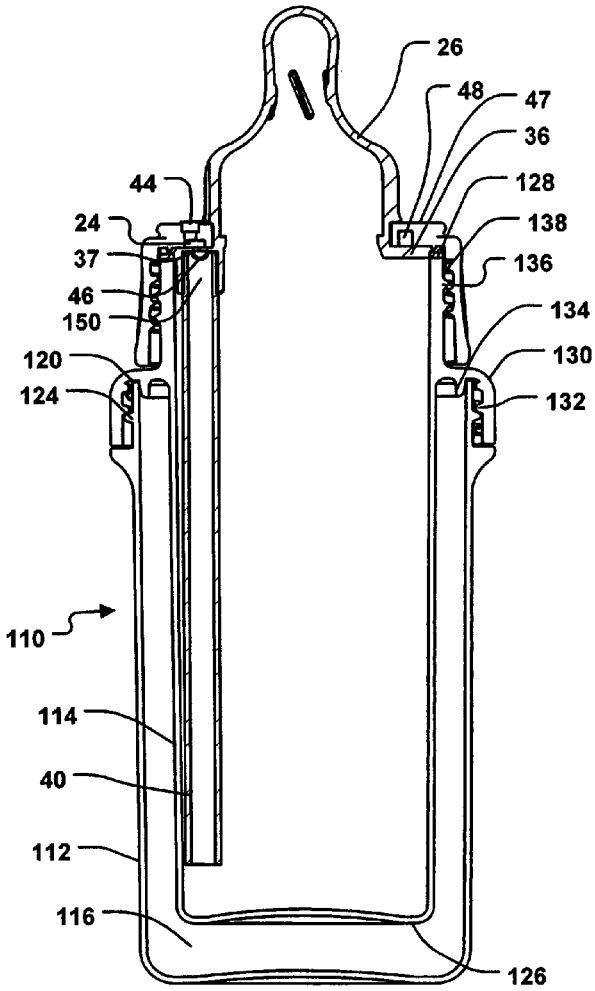

Another embodiment of the present invention is shown in FIG. 12. The embodiment of FIG. 12 is similar to the embodiment just described, but includes a filter and vent, as previously described. A baby bottle 110 includes an outer container 112 and an inner container 114, which when assembled together, create a space 116 to thermally isolate the contents of the inner bottle 114 from the atmosphere.

The outer container 112 can be made by any suitable manner such as blow molding. The inner container 114 can also be made in any suitable manner, such as injection molding.

Figure 13:
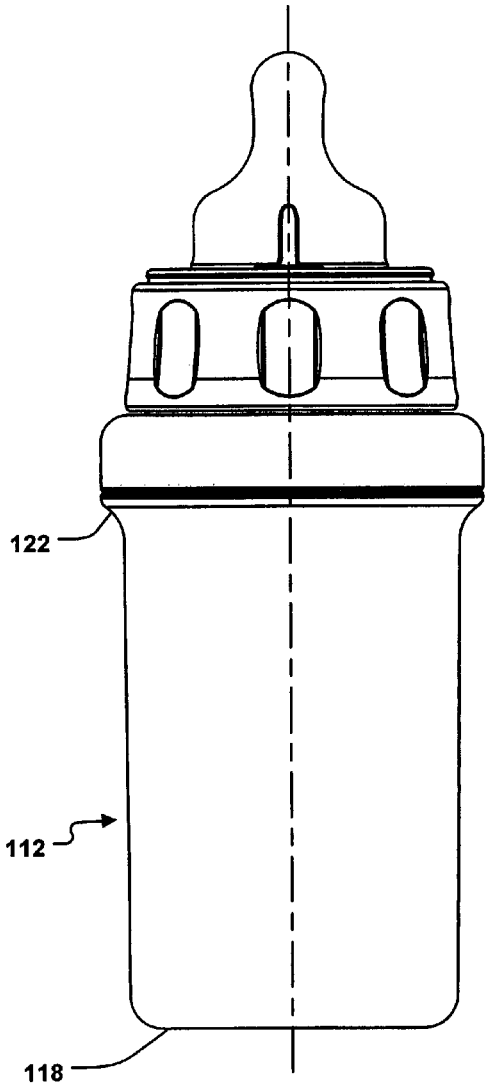
FIG. 13 is a plan view of the embodiment of FIGS. 9-12 shown assembled.

The container 112 has a bottom 118, an open top 120, a sealing lip 122 and exterior threads 124 (FIG. 13). The inner container 114 has a bottom 126, an open top 128, and a flange 130 having interior threads 132 for engagement with the threads 124 of the outer container 112. A sealing lip 134 is provided radially opposite the threads 132 when the outer bottle is secured, as seen in FIG. 12. The sealing lip 134 and the sealing lip 122 seal the space 116.

The inner container 114 also has outer threads 136 for engagement with inner threads 138 of the top cap 47. The nipple 26 is installed in the top cap 47 in the manner previously described. In addition, the top cap 47 can have the channel 48, the vent opening 24 with the filter, and the vent tube.

Figure 8:
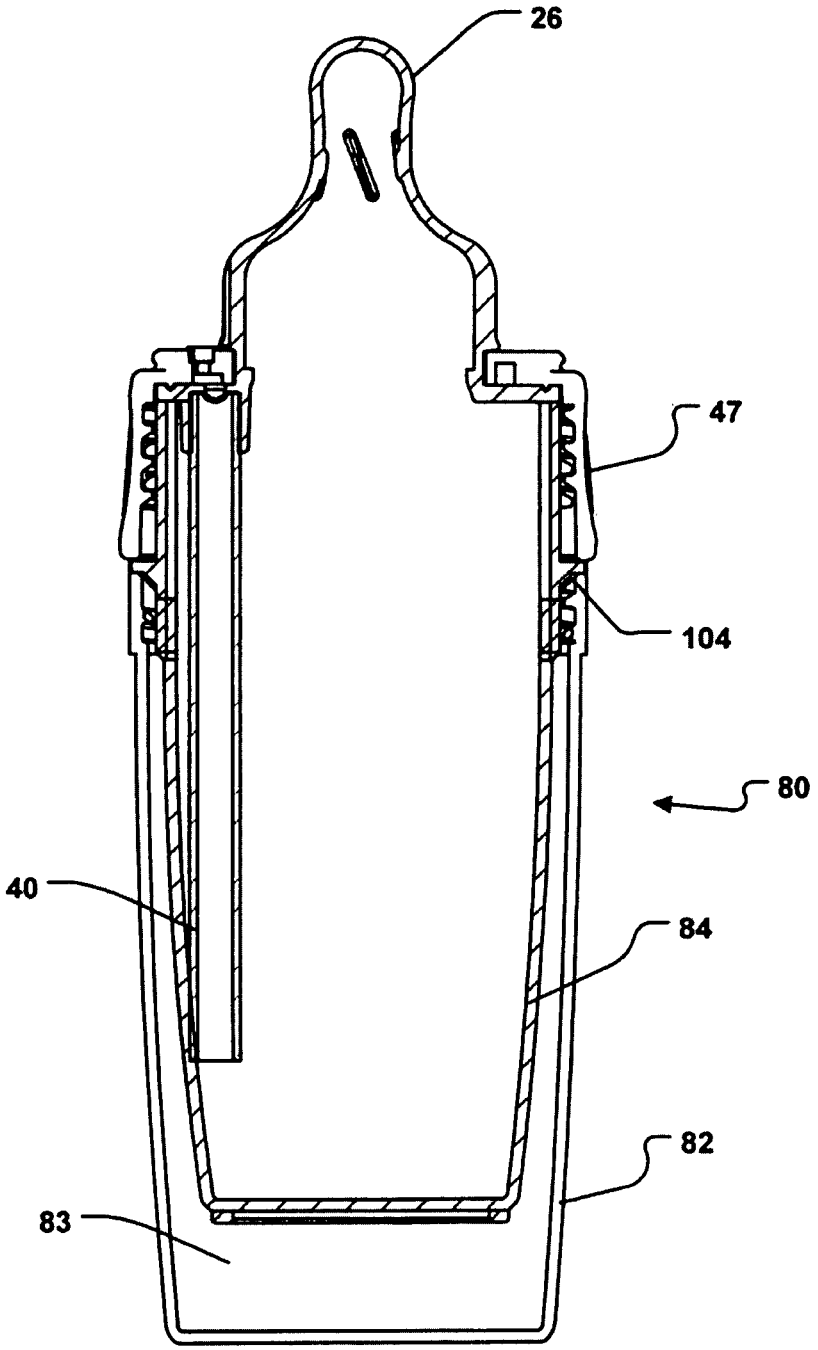
FIG. 8 is a cross-sectional diagram of another embodiment of the present invention.
Figure 14:
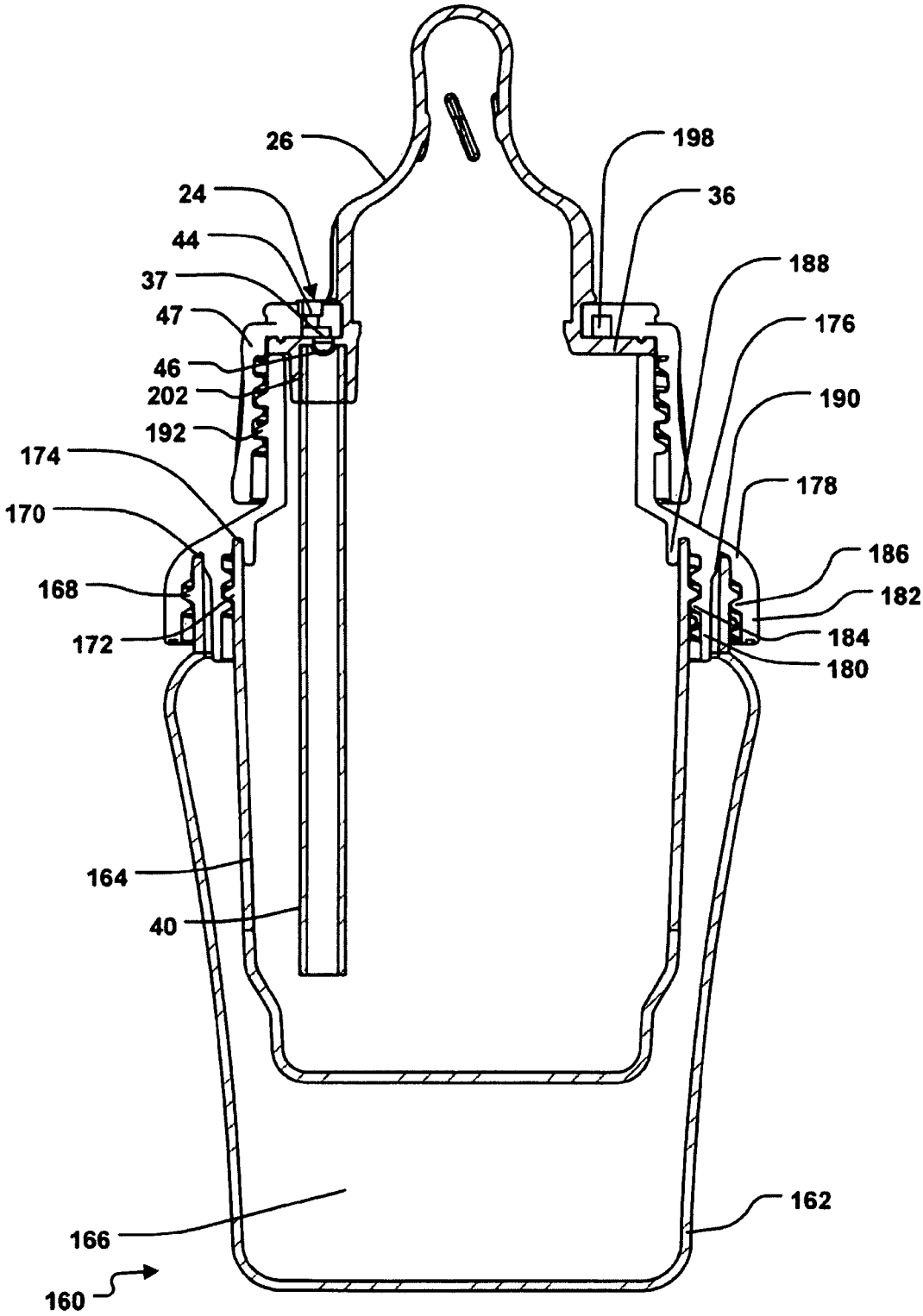
FIG. 14 is a cross-sectional diagram of another embodiment of the present invention; and, FIG. 15 is an exploded, cross-sectional view, of the embodiment of the invention shown in FIG. 2.

The embodiments of FIGS. 8, 12 and 13 are particularly useful with young infants, because the temperature in the inner container is better maintained throughout a feeding. Yet another embodiment of the present invention is shown in FIG. 14. In this embodiment, the inner and outer containers can both be used for feeding. This can be helpful with older infants, because the outer container can hold a larger serving.

The baby bottle 160 includes an outer container 162 and an inner container 164 that form a thermal isolation space 166 between the two containers. The outer container 162 has outer threads 168 adjacent an open top 170, and the inner container 164 has outer threads 172 adjacent a top opening 174. The containers 164 and 162 are secured to each other by an adapter 176 which includes a flange 178 having an inner wall 180 and an outer wall 182. The inner wall 180 has inside threads 184, and the outer wall 182 has inside threads 186. A sealing lip 188 is also provided, for sealing the contents of the inner container 164. The inner wall 180 has an extension 190 which seals the contents of the outer container 162 in the space 166.

The adapter 176 also has outer threads 192 at the end of the adapter 176 opposite the outer wall 182. The threads 192 accept the interior threads of a top cap 47, in which a nipple 26 is secured. The top cap 47 can also have a channel 198, and a filter 24 and a vent 202, as previously described.

With this embodiment, the outer container 162 is not needed, and can be removed in favor of the inner container 164. On the other hand, more milk or other substances can be given to a baby by removing the inner container 164 and filling the outer container 162 with nutritious substances.

While the principles of the invention have been described above in connection with specific apparatus and applications, it is to be understood that this description is made only by way of example and not as a limitation on the scope of the invention.

What is claimed is:

1. A baby bottle comprising:

a generally barrel shaped container having a circular open top and threads surrounding the outside of the open top;

a top cap having a top portion and a threaded side portion, the threaded side portion being capable of removably securing the top cap to the container, the top portion having a circular central opening and a top cap vent opening between said circular central opening and said side portion;

a nipple having a small opening at one end and a large opening at the other end, means for securing said nipple in said circular central opening of said top portion, a flange surrounding said large opening and extending outwardly therefrom, said flange having an upper side and a lower side, a vent opening passing through said flange from said upper side to said lower side, means on said lower side of said flange for securing a tube to said nipple in communication with said vent opening, said top cap vent opening, said flange vent opening and said tube creating a passageway from the inside of the container to the outside atmosphere, at least one filter in said passageway, at least one one-way valve in said passageway, said one-way valve opening to allow atmospheric air to enter the container and closing to prevent liquid in the container from escaping from the container through the passageway, whereby when said tube is secured to said nipple, said nipple is secured in said top cap, and said top cap is threadably secured to said container, with said nipple flange located between said open top of said container and an underside of said top portion, then said top cap vent opening, said flange vent opening, and said tube are in communication to form said passageway, and the inside of said container is vented through said passageway for the entry of air into said container as liquid is removed therefrom.

2. The baby bottle of claim 1, wherein said top cap vent opening and said flange vent opening are keyed so as to be aligned when the baby bottle is assembled.

3. The baby bottle of claim 1, wherein said top cap has a circular channel within said underside of said top portion between said circular central opening and said side portion, said top cap vent opening being in communication with said circular channel, and said vent opening in said flange also being in communication with said circular channel, said circular channel forming part of said passageway, whereby the inside of the container is vented, irrespective of the rotational position of said top cap when the baby bottle is assembled.

4. The baby bottle of claim 3 comprising a plurality of spaced radial protrusions in said circular channel, said radial protrusions partially blocking said circular channel, whereby liquid that enters said circular channel is at least partially obstructed by said radial protrusions and tends to accumulate between adjacent radial protrusions.

5. The baby bottle of claim 1 in which said means for securing said nipple comprises a circumferential indented portion in said nipple above and adjacent said upper side of said flange, said indented portion being sized to fit snugly within said circular central opening of said top cap.

6. The baby bottle of claim 1 in which said filter is located within said top cap vent opening.

7. The baby bottle of claim 1 in which said one-way valve is located within said flange vent opening.

8. The baby bottle of claim 1 in which said nipple is comprised of silicon material.

9. The baby bottle of claim 1 in which said means for securing said tube comprises a circular boss.

10. The baby bottle of claim 3 in which said means for securing said nipple comprises a circumferential indented portion in said nipple above and adjacent said upper side of said flange, said indented portion being sized to fit snugly within said circular central opening of said top cap.

11. The baby bottle of claim 3 in which said filter is located within said top cap vent opening.

12. The baby bottle of claim 3 in which said one-way valve is located within said flange vent opening.

13. The baby bottle of claim 3 in which said nipple is comprised of silicon material.

14. The baby bottle of claim 3 in which said means for securing said tube comprises a circular boss.

* * * * *